US008221092B2

(12) United States Patent
Chilcoat et al.

(10) Patent No.: US 8,221,092 B2
(45) Date of Patent: Jul. 17, 2012

(54) DOWNHOLE ELECTRICAL SUBMERSIBLE PUMP SEAL

(75) Inventors: David Chilcoat, Jenks, OK (US); Kevin Bierig, Tulsa, OK (US); Larry Parmeter, Broken Arrow, OK (US); Dan Merrill, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 849 days.

(21) Appl. No.: 12/262,447

(22) Filed: Oct. 31, 2008

(65) Prior Publication Data

US 2010/0111711 A1 May 6, 2010

(51) Int. Cl.
*F04B 17/03* (2006.01)

(52) U.S. Cl. ..... 417/53; 417/422

(58) Field of Classification Search ..... 417/53, 417/414, 422; 166/105, 68; 415/230, 901
See application file for complete search history.

(56) References Cited

U.S. PATENT DOCUMENTS

| | | | | |
|---|---|---|---|---|
| 4,667,737 | A | 5/1987 | Shaw | |
| 4,992,689 | A | 2/1991 | Bookout | |
| 6,602,059 | B1 | 8/2003 | Howell et al. | |
| 6,688,860 | B2 | 2/2004 | Du et al. | |
| 6,981,853 | B2 | 1/2006 | Du et al. | |
| 2007/0140876 | A1 | 6/2007 | Parmeter | |
| 2007/0277969 | A1 * | 12/2007 | Hall et al. | 166/105 |

* cited by examiner

*Primary Examiner* — Toan Ton
*Assistant Examiner* — Elmito Breval
(74) *Attorney, Agent, or Firm* — Bracewell & Giuliani LLP

(57) ABSTRACT

An improved seal assembly for a downhole electrical submersible pump assembly.

13 Claims, 2 Drawing Sheets

DOWNHOLE ELECTRICAL SUBMERSIBLE PUMP SEAL

BACKGROUND

1. Field of Invention

This invention relates in general to submersible well pumps, and in particular to seal assemblies used in combination with the motors that drive submersible well pumps.

2. Background of the Invention

In oil wells and other similar applications in which the production of fluids is desired, a variety of fluid lifting systems have been used to pump the fluids to surface holding and processing facilities. It is common to employ various types of downhole pumping systems to pump the subterranean formation fluids to surface collection equipment for transport to processing locations.

One such conventional pumping system is a submersible pumping assembly which is supported immersed in the fluids in the wellbore. The submersible pumping assembly includes a pump and a motor to drive the pump to pressurize and pass the fluid through production tubing to a surface location. A typical electric submersible pump assembly ("ESP") includes a submersible pump, an electric motor and a seal section interdisposed between the pump and the motor. The purpose of the seal section is to protect the motor from contamination as the wellbore fluid usually contains deleterious substances such as particulate solids and other debris from the formation. Conventional seal sections have not proved effective in preventing environmental contamination of the motor.

Thus, there is a need for a seal section capable of effectively preventing deleterious substances, such as particulate solids and other matter contained in formation fluids, from entering the motor where such contaminants can interfere with the efficient operation of the motor and can reduce the operational life of the motor. are frequently employed for pumping well fluid from lower pressure oil wells.

SUMMARY OF INVENTION

According to one aspect of the invention, an electric submersible pump assembly is provided that includes an electrical motor comprising a fluid cavity; a pump operably coupled to the electrical motor; a drive shaft coupled between the electrical motor and the pump; a seal assembly coupled between the electrical motor and the pump, the seal assembly comprising: a housing defining a cavity therein comprising a lower end coupled to the motor and an upper end coupled to the pump, an intake port operably coupled to the cavity and a region outside of the housing, a communication port operably coupled to the fluid cavity of the electrical motor, a lower central passage for receiving one end of the drive shaft, and an upper central passage for receiving another end of the drive shaft; a communication tube having a lower end that is operably coupled to the communication port and an upper end that extends into the housing; a bellows positioned within the cavity of the housing that receives and is fluidicly coupled to the upper end of the communication tube; and lower and upper sealing elements positioned within the lower and upper central passages, respectively, for sealing the interfaces between the lower and upper passages and the drive shaft.

According to another aspect of the invention, a method of operating an electric submersible pump assembly, the assembly comprising a pump, an electrical motor having a drive shaft for driving the pump and comprising a fluid cavity, and a seal assembly coupled between the pump and motor for receiving and sealingly engaging the drive shaft is provided that includes permitting fluids with the fluid cavity of the motor to flow into an upper portion of an overflow chamber positioned within the seal assembly; and permitting fluids outside of the seal assembly to possibly flow into a lower portion of the overflow chamber.

According to another aspect of the invention, a seal assembly for an electric submersible pump assembly having a pump and a motor having a drive shaft for driving the pump is provided that includes a housing defining a cavity therein comprising a lower end adapted to be coupled to the motor and an upper end adapted to be coupled to the pump, an intake port operably coupled to the cavity and a region outside of the housing, a communication port operably coupled to the fluid cavity of the electrical motor, a lower central passage for receiving one end of the drive shaft, and an upper central passage for receiving another end of the drive shaft; a communication tube having a lower end that is operably coupled to the communication port and an upper end that extends into the housing; a bellows positioned within the cavity of the housing that receives and is fluidicly coupled to the upper end of the communication tube; and lower and upper sealing elements positioned within the lower and upper central passages, respectively, for sealing the interfaces between the lower and upper passages and the drive shaft.

According to another aspect of the invention, a system for operating an electric submersible pump assembly, the assembly comprising a pump, an electrical motor having a drive shaft for driving the pump and comprising a fluid cavity, and a seal assembly coupled between the pump and motor for receiving and sealingly engaging the drive shaft is provided that includes means for permitting fluids with the fluid cavity of the motor to flow into an upper portion of an overflow chamber positioned within the seal assembly; and means for permitting fluids outside of the seal assembly to flow into a lower portion of the overflow chamber.

BRIEF DESCRIPTION OF DRAWINGS

Some of the features and benefits of the present invention having been stated, others will become apparent as the description proceeds when taken in conjunction with the accompanying drawings, in which.

DETAILED DESCRIPTION OF THE EXEMPLARY EMBODIMENTS

The present invention will now be described more fully hereinafter with reference to the accompanying drawings in which exemplary embodiments of the invention are shown. This invention may, however, be embodied in many different forms and should not be construed as limited to the illustrated embodiments set forth herein; rather, these embodiments are provided so that this disclosure will be through and complete, and will fully convey the scope of the invention to those skilled in the art. Like numbers refer to like elements throughout.

Figure 1:
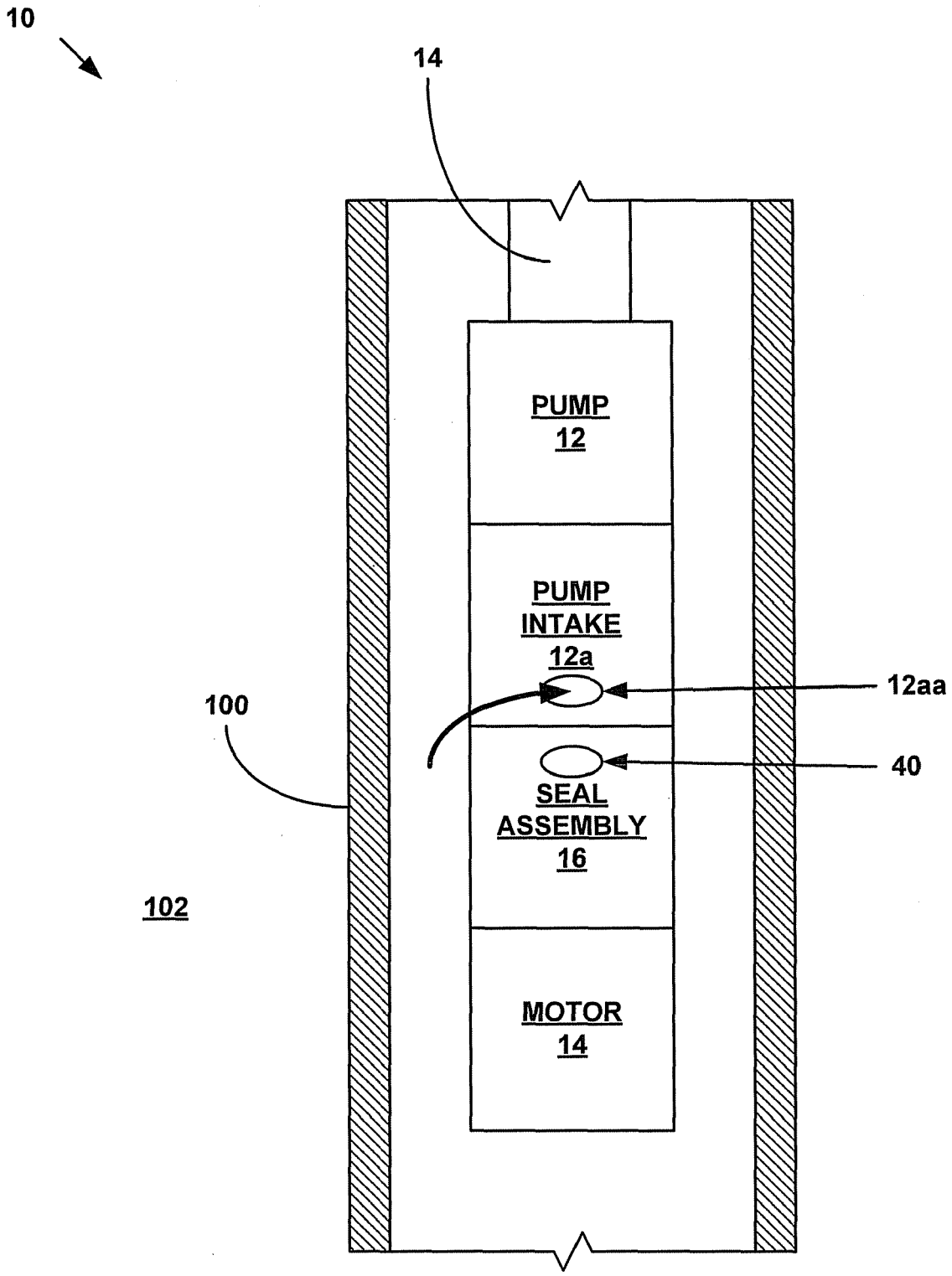
FIG. 1 is a fragmentary cross sectional view of an ESP assembly positioned within a wellbore that traverses a subterranean formation.
Figure 2:
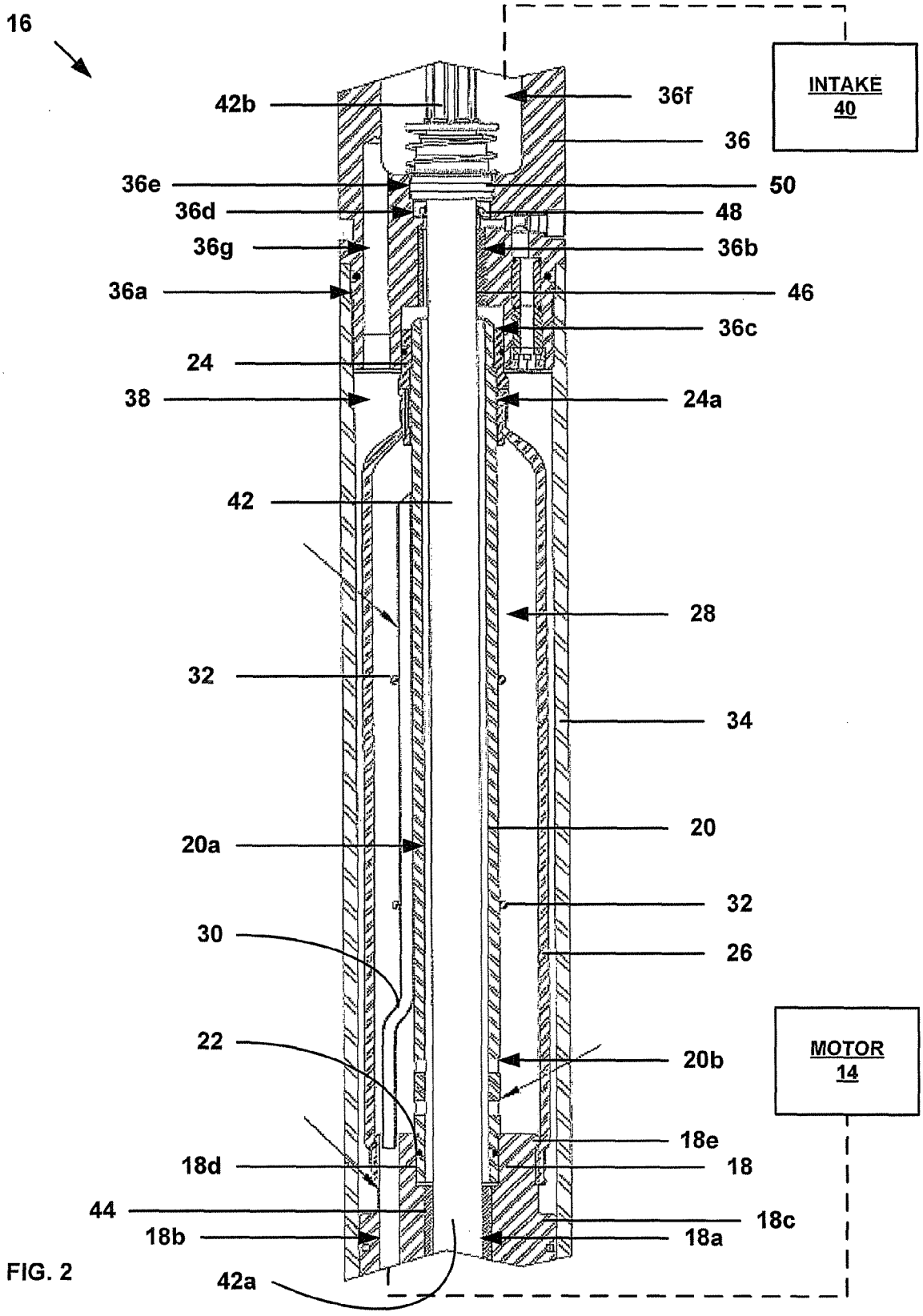
FIG. 2 is a fragmentary cross sectional view of the seal assembly of the ESP assembly of FIG. 1.

Referring initially to FIG. 1, an exemplary embodiment of an ESP assembly 10 includes a conventional submersible pump 12 having a pump intake 12*a* and an outlet that is coupled to a pipeline 14, or other conduit, for conveying the fluidic materials exhausted by the pump to one or more subsurface and/or surface holding and processing facilities. The pump 12 is operably coupled to a conventional motor 14 for driving the pump. The design and operation of the pump 12 and the motor 14 are considered well known to persons having ordinary skill in the art.

In an exemplary embodiment, a seal assembly 16 is interposed and coupled between the pump 12 and the motor 14 that includes a tubular support member 18 that defines a longitudinal passage 18*a* and a communication port 18*b* and includes an external flange 18*c*, an internal annular recess 18*d* at one end, and an external lip 18*e* at the tip of the one end. In an exemplary embodiment, the other end of the tubular support member 18 may be coupled to the motor 14. An end of an inner sleeve 20 that defines a longitudinal passage 20*a* and one or more radial communication holes 20*b* at one end is received within, mates with, and is coupled to the internal annular recess 18*d* of the tubular support member 18. In an exemplary embodiment, one or more o-ring seals 22 are provided within the interface between the end of the inner sleeve 20 and the internal annular recess 18*d* of the tubular support member 18 for sealing the interface there between. A tubular sealing member 24 receives, mates with, seals to, and is coupled to the other end of the inner sleeve 20 that includes an external annular recess 24*a*.

An end of an elastomeric tubular bellows 26 receives, mates with, seals to, and is coupled to the end of the tubular support member 18 and the other end of the bellows receives, mates with, seals to, and coupled to the external annular recess 24*a* of the tubular sealing member 24 coupled to the other end of the inner sleeve 20. In this manner, a chamber 28 is defined within the bellows 26. An end of a communication tube 30 is received within, mates with, seals to, and is coupled to an end of the communication port 18*b* of the tubular support member 18 and the other end of the communication tube extends into an opposing end of the chamber 28 within the bellows 26. One or more support rings 32 surround the inner sleeve 20 and communication tube 30 for supporting the communication tube within the chamber 28 of the bellows 24.

An end of an outer sleeve 34 is receives, mates with, seals to, and is coupled to an end of the tubular support member 18 and the other end of the outer sleeve receives, mates with, seals to, and is coupled to an external annular recess 36*a* of a tubular support member 36 that defines a longitudinal passage 36*b* including an internal annular recess 36*c* at one end and internal annular recesses, 36*d*, 36*e* and 36*f*, at another end, and a communication port 36*g*. In this manner, an annular chamber 38 is defined within the outer sleeve 34 that surrounds and is fluidicly isolated from the chamber 28 defined within the bellows 26. Furthermore, in an exemplary embodiment, the chamber 38 is fluidicly coupled to the communication port 36*g* which is, in turn, fluidicly coupled to an intake 40. In this manner, fluidic materials external to the seal assembly 16 may enter the chamber 38 thereby equalizing the pressure within the chamber 38 with the pressure within the chamber 28.

In an exemplary embodiment, the other end of the tubular support member 36 may be coupled to the pump 12. In an exemplary embodiment, an end of the tubular sealing member 24 is received within, mates with, seals to, and is coupled to the internal annular recess 36*c* of the tubular support member 36. In an exemplary embodiment, a drive shaft 42 is received within the longitudinal passages, 18*a*, 20*a*, and 36*b*, of the tubular support member 18, the inner sleeve 20, and the tubular support member 36, respectively, for transmitting torque from the motor 14 to the pump 12. In particular, the lower end 42*a* of the drive shaft 42 may be coupled to the motor 14 while the upper end 42*b* of the drive shaft may be coupled to the pump 12.

In an exemplary embodiment, bearings, 44 and 46, are positioned within the interfaces between the tubular support member 18 and the tubular support member 36, respectively, and the drive shaft 42 for supporting the drive shaft 42 therein. In an exemplary embodiment, a seal 48 is positioned within annular recess 36*d* for sealing the interface between the annular recess and the drive shaft 42 and a sealing member 50 is positioned within the annular recess 36*e* for sealing the interface between the annular recess and the drive shaft 42.

In an exemplary embodiment, during the operation of the ESP assembly 10, the assembly may be positioned within a wellbore casing 100 that traverses a subterranean formation 102. In an exemplary embodiment, the orientation of the wellbore casing may be substantially aligned with the vertical direction.

The motor 14 may then be operated to transmit torque to the pump 12 using the drive shaft 42. In this manner, fluidic material within the wellbore casing 100 will enter the pump intake 12*a* of the pump 12 through one or more inlet ports 12*aa* provided in the pump intake. As a result, the fluidic materials will then be exhausted from the outlet of the pump 12 into the conduit 14. As will be recognized by persons having ordinary skill in the art, conventional motors such as the motor 14 define a cavity that contains a dielectric and/or lubricating fluid such as, for example, motor oil that expands and contracts in volume as function of the operating conditions within the motor. In an exemplary embodiment, during the operation of the motor 14, the dielectric fluid within the motor may expand in volume such that the dielectric fluid may enter the chamber 28 defined within the bellows 26 through the communication port 18*b* and communication tube 30. Since the annular chamber 38 is exposed to the fluidic materials within the wellbore casing 100 by means of the fluidic communication between the intake 40 and the communication port 36*g*, the operating pressure within the chamber 28 should substantially equal the operating pressure within the annular chamber.

Since the dielectric fluid dielectric fluid that may enter the chamber 28 defined within the bellows 26 through the communication port 18*b* and communication tube 30 has a lower density than typical fluidic materials found within the wellbore casing 100, in the event of an leakage of the interfaces and sealing elements of the seal assembly 16 such that fluids from the wellbore casing may enter the chamber 28 through the passages 20*b* defined in the inner sleeve 20, the dielectric fluid of the motor, by virtue of its lower density, should float on top of any such wellbore casing fluids. As a result, any fluids from within the wellbore casing that may enter the chamber 28 should remain below the vertical level of the open end of the communication tube 30. In this manner, in the event of a subsequent contraction of the volume of the dielectric fluid within the motor 14, any fluids within the chamber 28 that may then be drawn back into the open end of the communication tube 30 should not include any fluidic materials from the interior of the wellbore casing. In this manner, contaminants such as the fluidic materials within the wellbore casing 100 should be prevented from entering the interior of the motor 14.

In an exemplary embodiment, a plurality of seal assemblies 16 may be connected to one another in series.

It is understood that variations may be made in the above without departing from the scope of the invention. While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

The invention claimed is:

1. An electric submersible pump assembly, comprising:

an electrical motor comprising a fluid cavity;

a pump operably coupled to the electrical motor;

a drive shaft coupled between the electrical motor and the pump;

a seal assembly coupled between the electrical motor and the pump, the seal assembly comprising:

a housing defining a cavity therein comprising a lower end coupled to the motor and an upper end coupled to the pump, an intake port operably coupled to the cavity and a region outside of the housing, a communication port operably coupled to the fluid cavity of the electrical motor, a lower central passage for receiving one end of the drive shaft, and an upper central passage for receiving another end of the drive shaft;

a communication tube having a lower end that is operably coupled to the communication port and an upper end that extends into the housing;

a bellows positioned within the cavity of the housing that receives and is fluidicly coupled to the upper end of the communication tube; and lower and upper sealing elements positioned within the lower and upper central passages, respectively, for sealing the interfaces between the lower and upper passages and the drive shaft.

2. The assembly of claim 1, wherein the upper end of the communication tube is positioned proximate an upper end of the bellows.

3. The assembly of claim 1, further comprising a sleeve positioned within the housing of the seal assembly having a lower end received within and sealingly engaging the lower central passage of the housing and an upper end received within and sealingly engaging the upper central passage of the housing; wherein the sleeve receives the drive shaft.

4. The assembly of claim 1, wherein the sleeve defines one or more radial passages proximate a lower end of the sleeve.

5. A method of operating an electric submersible pump assembly, the assembly comprising a pump, an electrical motor having a drive shaft for driving the pump and comprising a fluid cavity, and a seal assembly coupled between the pump and motor for receiving and sealingly engaging the drive shaft, comprising:

permitting fluids with the fluid cavity of the motor to flow into an upper portion of an overflow chamber positioned within the seal assembly; and permitting fluids outside of the seal assembly to flow into a lower portion of the overflow chamber.

6. The method of claim 5, wherein the overflow chamber comprises a resilient chamber.

7. The method of claim 5, further comprising exposing the overflow chamber to the operating pressure of the fluids outside of the seal assembly.

8. A seal assembly for an electric submersible pump assembly having a pump and a motor having a drive shaft for driving the pump, comprising:

a housing defining a cavity therein comprising a lower end adapted to be coupled to the motor and an upper end adapted to be coupled to the pump, an intake port operably coupled to the cavity and a region outside of the housing, a communication port operably coupled to the fluid cavity of the electrical motor, a lower central passage for receiving one end of the drive shaft, and an upper central passage for receiving another end of the drive shaft;

a communication tube having a lower end that is operably coupled to the communication port and an upper end that extends into the housing;

a bellows positioned within the cavity of the housing that receives and is fluidicly coupled to the upper end of the communication tube; and lower and upper sealing elements positioned within the lower and upper central passages, respectively, for sealing the interfaces between the lower and upper passages and the drive shaft.

9. The assembly of claim 8, wherein the upper end of the communication tube is positioned proximate an upper end of the bellows.

10. The assembly of claim 8, further comprising a sleeve positioned within the housing of the seal assembly having a lower end received within and sealingly engaging the lower central passage of the housing and an upper end received within and sealingly engaging the upper central passage of the housing; wherein the sleeve receives the drive shaft.

11. A system for operating an electric submersible pump assembly, the assembly comprising a pump, an electrical motor having a drive shaft for driving the pump and comprising a fluid cavity, and a seal assembly coupled between the pump and motor for receiving and sealingly engaging the drive shaft, comprising:

means for permitting fluids with the fluid cavity of the motor to flow into an upper portion of an overflow chamber positioned within the seal assembly; and means for permitting fluids outside of the seal assembly to flow into a lower portion of the overflow chamber.

12. The system of claim 11, wherein the overflow chamber comprises a resilient chamber.

13. The system of claim 11, further comprising means for exposing the overflow chamber to the operating pressure of the fluids outside of the seal assembly.

* * * * *

UNITED STATES PATENT AND TRADEMARK OFFICE

CERTIFICATE OF CORRECTION

PATENT NO. : 8,221,092 B2
APPLICATION NO. : 12/262447
DATED : July 17, 2012
INVENTOR(S) : David Chilcoat et al.

It is certified that error appears in the above-identified patent and that said Letters Patent is hereby corrected as shown below:

Column 3, line 38, delete “Is” before “receives”

Column 4, line 1, delete “,” after “bearings”

Column 4, line 1, delete “,” after “46”

Column 4, line 38, delete “dlelectric fluid” (second occurrence)

Signed and Sealed this
Twenty-seventh Day of November, 2012

David J. Kappos

David J. Kappos
*Director of the United States Patent and Trademark Office*